US007625333B2

(12) United States Patent
Yardley et al.

(10) Patent No.: US 7,625,333 B2
(45) Date of Patent: Dec. 1, 2009

(54) SINGLE-PLY DISPENSER NAPKIN

(75) Inventors: Craig D. Yardley, Deer Park, IL (US); Chester W. Gooding, Jr., Neenah, WI (US); Byron E. Burrier, Neenah, WI (US)

(73) Assignee: Georiga-Pacific Consumer Products LP, Atlanta, GA (US)

( * ) Notice: Subject to any disclaimer, the term of this patent is extended or adjusted under 35 U.S.C. 154(b) by 881 days.

(21) Appl. No.: 10/689,379

(22) Filed: Oct. 20, 2003

(65) Prior Publication Data

US 2005/0061827 A1 Mar. 24, 2005

Related U.S. Application Data

(62) Division of application No. 09/633,819, filed on Aug. 7, 2000, now abandoned, which is a division of application No. 09/049,103, filed on Mar. 27, 1998, now Pat. No. 6,306,480.

(51) Int. Cl.
*B31B 1/26* (2006.01)

(52) U.S. Cl. ..... 493/405; 493/408

(58) Field of Classification Search ..... 493/395, 493/405, 408, 409, 410, 416, 436, 438, 439, 493/440

See application file for complete search history.

(56) References Cited

U.S. PATENT DOCUMENTS

| | | | | | |
|---|---|---|---|---|---|
| 660,726 | A | | 10/1900 | Hart | |
| 868,854 | A | | 10/1907 | Firm | |
| 1,256,334 | A | * | 2/1918 | Lazar | 221/48 |
| 1,600,837 | A | | 9/1926 | Melker | |
| 1,835,495 | A | | 12/1931 | Johnson | |
| 1,992,179 | A | | 2/1935 | Blossner et al. | |
| 2,177,722 | A | | 10/1939 | Josephs | |
| 2,602,013 | A | | 7/1952 | Amerslav | |
| 3,291,479 | A | | 12/1966 | Greiner et al. | |
| 3,401,928 | A | * | 9/1968 | Frick | 270/40 |
| 3,612,264 | A | | 10/1971 | Trunick | |
| 3,709,077 | A | | 1/1973 | Trogan et al. | |
| 3,866,905 | A | | 2/1975 | Trogan et al. | |
| 3,970,215 | A | | 7/1976 | McLaren et al. | |
| 4,060,227 | A | | 11/1977 | Landgraf et al. | |
| 4,360,194 | A | | 11/1982 | Bradley | |
| 4,469,243 | A | | 9/1984 | Ito et al. | |
| 4,475,730 | A | | 10/1984 | Trogan | |
| 4,502,675 | A | | 3/1985 | Clark et al. | |
| 4,508,528 | A | | 4/1985 | Hirsch et al. | |
| 4,521,209 | A | | 6/1985 | DuFresne | |
| 4,540,396 | A | | 9/1985 | Berthelsen | |
| 4,605,210 | A | | 8/1986 | Heckler | |
| 4,607,830 | A | | 8/1986 | Schumann | |
| 4,638,921 | A | | 1/1987 | Sigl et al. | |
| 4,679,703 | A | | 7/1987 | De Luca | |
| 4,812,195 | A | | 3/1989 | Vijuk | |
| 4,850,949 | A | | 7/1989 | Dallaserra | |
| 4,859,518 | A | | 8/1989 | Schutz | |
| 4,865,579 | A | | 9/1989 | Kirby et al. | |
| 4,913,312 | A | | 4/1990 | Boutin | |
| 4,921,235 | A | | 5/1990 | Biagiotti et al. | |

(Continued)

*Primary Examiner*—Christopher Harmon
(74) *Attorney, Agent, or Firm*—Finnegan, Henderson, Farabow, Garrett & Dunner L.L.P.

(57) ABSTRACT

The present invention is a new elongate single-ply paper napkin that achieves the necessary absorbency, strength, hand feel and softness for commercial use but which is less expensive than traditional napkin products. More particularly, the invention is a single-ply napkin that contains folds running only in the transverse direction of the product, i.e. perpendicular to the length of the napkin.

11 Claims, 4 Drawing Sheets

U.S. PATENT DOCUMENTS

| | | | | |
|---|---|---|---|---|
| 4,950,511 | A | 8/1990 | Francis | |
| 5,016,863 | A | 5/1991 | Birkmair | |
| 5,023,126 | A * | 6/1991 | Stevens et al. | 428/126 |
| 5,088,975 | A | 2/1992 | Ghilardi | |
| 5,090,592 | A | 2/1992 | Petterson et al. | |
| 5,118,554 | A * | 6/1992 | Chan et al. | 428/126 |
| 5,162,035 | A | 11/1992 | Baker | |
| 5,163,892 | A | 11/1992 | Morris | |
| 5,316,177 | A | 5/1994 | Boldt | |
| 5,356,032 | A | 10/1994 | Rhodes | |
| 5,356,131 | A | 10/1994 | Mauro | |
| 5,368,188 | A | 11/1994 | Twardowski | |
| 5,399,241 | A | 3/1995 | Oriaran et al. | |
| 5,458,950 | A | 10/1995 | Bredenick et al. | |
| 5,535,887 | A | 7/1996 | Young et al. | |
| 5,540,354 | A | 7/1996 | Annand | |
| 5,565,258 | A | 10/1996 | McConnell et al. | |
| 5,676,056 | A | 10/1997 | Stein et al. | |
| 5,688,394 | A | 11/1997 | McBride, Jr. et al. | |
| 5,690,250 | A * | 11/1997 | Gooding et al. | 221/47 |
| 5,697,879 | A | 12/1997 | Nokelainen | |
| 5,709,641 | A | 1/1998 | Vaquero | |
| 5,716,691 | A | 2/1998 | Chan | |
| 5,722,774 | A | 3/1998 | Hartz | |
| 5,803,889 | A | 9/1998 | Littman | |
| 5,964,351 | A | 10/1999 | Zander | |
| 6,033,761 | A | 3/2000 | Dwiggins et al. | |
| 6,068,731 | A | 5/2000 | Dwiggins et al. | |
| 6,143,131 | A | 11/2000 | Dwiggins et al. | |
| 6,202,889 | B1 | 3/2001 | Veith | |
| 6,394,728 | B1 | 5/2002 | Boss | |
| 6,730,012 | B2 * | 5/2004 | Bando | 493/413 |

* cited by examiner

SINGLE-PLY DISPENSER NAPKIN

This is a division of application Ser. No. 09/633,819, filed Aug. 7, 2000, which is a division of application Ser. No. 09/049,103, filed Mar. 27, 1998, issued as U.S. Pat. No. 6,306,480 all of which are incorporated herein by reference.

FIELD OF THE INVENTION

The present invention relates to a new elongate single-ply paper napkin that achieves the necessary absorbency, strength, hand feel and softness for commercial use but which is less expensive than traditional napkin products. More particularly, the invention relates to a napkin that contains folds running only in the transverse direction of the product, i.e. perpendicular to the length of the napkin. The present invention further relates to a method for efficiently producing a single-ply paper napkin in which the cost, in terms of man-hours, machine-time and starting materials, is reduced, the speed of production can be increased, the control during production can be improved, and highly desirable consumer properties can be maintained.

Additionally, the present invention relates to a stack of new single-ply paper napkins that achieve the necessary absorbency, strength, hand feel and softness while at the same time reducing the size of the stack, and thereby improving storage characteristics. Finally, the present invention relates to a napkin dispenser containing a stack of single-ply napkins according to the present invention that requires less maintenance to refill and allows the individual napkins to be removed easily.

BACKGROUND OF THE INVENTION

With the prevalence of fast food establishments, single use dispenser napkins have become important. Single use dispenser napkins are highly desirable in the quick service restaurant industry because they are readily dispensed and are highly sanitary but, most of all, because they are economical. Dispenser napkins are commonly found on countertops or tabletops in lunchrooms and restaurants. Because of their public location, the ability of the napkins to be dispensed in a highly sanitary manner is an important attribute.

Dispenser napkins are paper products that are folded to achieve a size, strength and bulk based on the desired end use. Dispenser napkins are folded in a variety of ways to accommodate variations in intended use or dispenser style. The folds of the napkin are intended to enable a napkin to be contained in a reasonably sized dispenser, reinforce the napkin, to make ft strong enough to resist tearing or tabbing during the dispensing process and also to facilitate the removal of individual napkins or sheets from the dispenser.

A variety of napkin configurations are present in the marketplace today. In one example, a stack of napkins is created from sheets comprising a generally rectangular central panel and two end panels. The central panel is bordered by two free edges and two fold lines on the opposite sides of the central panel, while each end panel is bordered by three free edges and a fold line dividing it from the central panel. When viewing the folded sheet from the side, the sheet resembles a flattened "Z" and hence is termed a Z-fold napkin. When stacked, one end panel is often positioned interfolded with the end panel of the next adjacent sheet. As one sheet is dispensed, the end panel of the next sheet will become accessible to the user from the dispenser. U.S. Pat. Nos. 2,602,013 and 5,368,188 disclose paper products folded in this "Z" configuration.

During removal of standard "Z" fold sheets from a dispenser, the user can only grasp a single layer of the paper sheet. Because sheets folded in the "Z" configuration are interfolded, when removing the sheet by grasping the exposed flap, the user is actually pulling not one, but at least a portion of two or more sheets out of the dispenser with this single end panel. Because of the stresses associated with removal of more than one sheet, tearing of "Z" folded sheets during dispensing is a common problem.

Conventional methods of folding paper napkins produce folds in both the longitudinal direction and the transverse direction of the napkin. According to the present invention, "folded in the longitudinal direction" of the napkin defines a napkin containing a fold running perpendicular to the width of the fully opened napkin.

Similarly, when a napkin is "folded in the transverse direction," it has a fold running parallel to the width of the fully opened napkin. The width of the napkin according to the present invention does not relate to the machine direction or cross machine direction of the paper web, but instead, simply refers to the shortest free edge of the fully opened napkin sheet.

U.S. Pat. No. 1,600,837 to Melker discloses a paper napkin folded in both the longitudinal and transverse direction. Folds in both directions allow the napkin to be opened to cover, for example, the user's lap during use and also to provide a napkin with a reinforced flap. This reinforced flap is designed to prevent the napkin from being torn or mutilated while being removed from a dispenser.

Accommodating both longitudinal and transverse folds requires the napkin web and the automated folders conventionally employed to produce these dispenser napkins be moved relative to one another. Additionally, because the napkin panels produced by a longitudinal fold are often not equal, a folded napkin with an unequal thickness is often produced. Commonly, either one end or one side of the folded napkin is thicker than the other, resulting in high and low strength areas.

Napkins with this type of non-uniform thickness often have a problem dispensing properly from conventional dispensing devices. When such napkins are stacked, the high firmness areas are usually placed adjacent one another. This creates a firm side or firm end and a soft side or soft end in the stack of napkins. This soft side can be crushed or folded when a stack of napkins is banded together using either a paper or plastic band. Crushing or folding often results in wrinkles that interfere with the dispensability of the napkin product.

The present invention overcomes these and other drawbacks by providing single-ply paper napkins of substantially uniform strength and thickness that are free of longitudinal folds. A single-ply paper napkin according to the present invention contains folds in only a single direction of the product—the transverse direction. Because the napkin is both formed from a single ply of napkin stock and free of longitudinal folds, operational economies in the production processes make it possible to produce these napkins at significantly lower cost than napkins formed either from multiple plies of napkin stock with longitudinal folds. The paper napkins according to the present invention possess the highly desirable combination of low cost and improved dispensability.

In most cases, napkins employed in connection with commercial food service or the "away-from-home" market are not purchased by the end user. Thus, the primary considerations by a purchaser of these napkins are usually cost, number of napkins that can be fit into a dispenser and dispensability characteristics. The purchaser of the napkins wants to make it easy for their customer, the end user, to remove a single napkin from the dispenser, but relatively more difficult to grab a handful. Similarly, because of the high volume of the napkins often used by these businesses, the space required for storing cases of napkins can assume considerable significance.

The paper napkins according to the present invention address these problems associated with prior art products. They are low in cost, easily loaded into dispensers, easily dispensed and more compact. The preferred napkins, also impart pleasing tactile sensations to the user while the napkin is in use. The paper napkins according to the present invention avoid tabbing or tearing when removed from a paper napkin dispenser and retain their physical integrity during use. Most importantly, single-ply paper napkins according to the present invention may be produced at significantly lower cost than conventional napkins.

The napkins of the present invention are produced using high strength single-ply paper webs. In a given period of time, a paper machine forming a single-ply paper web can produce more than one and a half times the number of napkins than it can produce when being used to produce comparable two ply napkins. The stronger single-ply paper web generally allows for better control during production. The strength of this single ply web makes it more easily converted on many types of conventional converting equipment and thus, allows higher running speeds than with lighter webs.

The stronger single-ply web of the napkins according to the present invention can achieve better emboss definition enabling the emboss patterns to be retained longer during packaging. Moreover, the stronger single-ply web can conserve starting material, especially fibers, used in the production of the web since the single ply web of the napkins according to the present invention will often be lighter than a double ply web. Because the total weight of the napkins are reduced on an area basis, the amount of fiber required to make a ream of napkins can be considerably less than the amount of fiber required to make a ream of conventional napkins.

Up to a 40-50% increase in productivity can be achieved because of the increased efficiency of the processing steps necessary to produce the single-ply paper napkins of the present invention. An automated folder producing napkins according to the present invention can run significantly faster because there is no need to turn the napkin web for folds in both the longitudinal and transverse direction.

Finally, because single-ply paper napkins according to the present invention can be made more compact they can take as little as two-thirds the space associated with a similar count of prior art napkins. This reduction in space allows both for a decrease in storage space and for more napkins to be able to be placed into conventional cassette napkin dispensers, thereby reducing the frequency that the dispensers must be refilled.

Paper napkins according to the present invention are preferably folded and arranged in a stack which makes it possible to remove the paper napkins from a napkin dispenser one at a time without unsanitary contact with the other napkins in the dispenser.

SUMMARY OF THE INVENTION

The present invention for the first time overcomes the drawbacks associated with the prior art and attains the aforementioned benefits by providing a single-ply paper napkin free of longitudinal folds which can be produced more efficiently than conventional napkins. More particularly, the present invention is concerned with the development of a single-ply paper napkin which is resistant to tabbing or tearing when removed from a paper napkin dispenser.

Elimination of longitudinal folds can reduce or eliminate many of the changes of direction normally imposed on the traveling web in the converting process and thereby increase the speed and efficiency of the production process. In automated folders conventionally employed in the production of dispenser napkins, the need to re-orient the web to make transverse folds after forming longitudinal folds can slow the process considerably.

It is a further object of the present invention to provide a stack of single-ply paper napkins characterized by a reduction in bulk without a reduction in strength or absorbency.

Finally, it is an object of the present invention to provide a more efficient process for the production of a single-ply paper napkin characterized by improved strength and dispensability. This production process includes both the use of automated folders conventionally employed in the production of dispenser napkins and a new continuous production process capable of running at higher speeds than present processes.

These and other objects have been achieved by the present invention which is directed to a single ply paper napkin containing only transverse folds. In one embodiment, the present invention is directed to a substantially rectangular paper napkin comprising a single-ply paper web where the longitudinal dimension (the longest free edge) of the rectangle is at least about 1.7 times that of the transverse dimension (the shortest free edge) and wherein the napkin contains at least one transverse fold, but no longitudinal fold.

In another embodiment, the present invention provides a substantially rectangular paper napkin comprising a single-ply paper web where the longitudinal dimension of the rectangle is at least about 1.7 times that of the transverse dimension and where the napkin also contains at least one transverse fold, but no longitudinal folds. In this embodiment, the paper web has a longitudinal dimension ranging from about 9½ inches to about 12½ inches, a longitudinal-to-transverse aspect ratio of at least about 1.7 to 1, and a basis weight of at least about 16 lbs/3000 sq ft ream. The napkin further contains at least one transverse fold, and the first transverse fold bisects the longitudinal dimension of the paper web into two panels of substantially the same size.

In yet another embodiment, the present invention provides a substantially rectangular paper napkin comprising a single-ply paper web where the longitudinal dimension of the rectangle is at least about 1.7 times that of the transverse dimension and where the napkin contains at least one transverse fold, but no longitudinal folds. In this embodiment, the panels created by the at least one transverse fold are not substantially the same size.

In still another embodiment, the present invention provides a substantially rectangular paper napkin comprising a single-ply paper web where the longitudinal dimension ranges from about 11½ inches to about 17½ inches and the longitudinal dimension is at least about 1.7 times that of the transverse dimension, and where the basis weight is at least about 16 lbs/3000 sq ft ream. The napkin contains no longitudinal folds, two transverse folds, and has an off-fold configuration. The first transverse fold divides the longitudinal dimension of the single-ply paper web approximately in half. A second transverse fold again subdivides the folded web into unequal sections. The resulting web when fully opened displays three transverse folds and 4 panels bounded by free edges and one or more folds. With an off fold configuration, the two center panels will be of like size and usually smaller than the two end panels.

In another embodiment, the present invention provides, a substantially rectangular paper napkin comprising a single-ply paper web where the longitudinal dimension of the rectangle is at least about 1.7 times that of the transverse dimension and where the napkin contains at least three transverse folds, but no longitudinal folds. In this embodiment, the resulting web when fully opened displays at least three transverse folds dividing the web into panels of substantially the same size.

In another embodiment, the present invention provides a substantially rectangular paper napkin comprising a single-ply paper web where the longitudinal dimension of the rectangle is at least about 1.7 times that of the transverse dimension, wherein the single-ply paper web has a longitudinal dimension ranging from about 11 to 17 inches, a basis weight of at least about 16 lbs/3000 sq ft ream, wherein the napkin contains no longitudinal folds, three transverse folds, and has an off-fold configuration, and further wherein a first transverse fold divides the longitudinal dimension of the single-ply paper web, a second transverse fold divides the longitudinal dimension between the first transverse fold in the napkin and a free transverse edge of the paper web, and a third transverse fold divides the longitudinal dimension between the second transverse fold in the napkin and the free transverse edge of the paper web.

Another object of the present invention to provide a substantially rectangular paper napkin comprising a single-ply paper web wherein the longitudinal dimension of the rectangle is about 2 times that of the transverse dimension and wherein the napkin contains no longitudinal folds and one transverse fold dividing the napkin into two panels of substantially equal size.

Additionally, it is an object of the present invention to provide a substantially rectangular paper napkin comprising a single-ply paper web wherein the longitudinal dimension of the rectangle is at least about 2 times that of the transverse dimension and wherein the napkin contains no longitudinal folds and a first transverse fold and a basis weight of at least about 16 lbs/3000 sq ft ream. In this embodiment, the web is folded in a first direction to create two panels of unequal area. The folded web is then again folded in the opposite direction to create a panel on each side of the largest panel. When unfolded, the web of this embodiment has three transverse folds defining four panels. The first panel is bounded by the first transverse fold and three free edges. The second panel is bounded by the first and second transverse folds and two free longitudinal edges. The third panel is bounded by the second and third transverse folds and two free longitudinal edges. Finally, the fourth panel is bounded by the third transverse fold and three free edges. In a most preferred embodiment, the first panel has an area that is larger than the area of the remaining panels. The second, third and fourth panels have a substantially equal area.

A further object of the present invention is to provide a stack of paper napkins comprising a plurality of folded paper napkins oriented in the same direction and stacked one on top of another, each folded paper napkin comprising a single-ply paper web having a longitudinal dimension and a transverse dimension, wherein the paper web has a longitudinal-to-transverse aspect ratio of at least about 2 to 1, and further wherein the napkin contains no longitudinal folds and at least one transverse fold. More particularly, the stack of paper napkins has packaging extending around the formed stack.

Further, it is an object of the present invention to provide a paper napkin dispenser comprising a housing comprising an opening for dispensing paper napkins from an array or packet of paper napkins in an individual manner; and a packet of paper napkins comprising a plurality of folded paper napkins oriented in the same direction and stacked adjacent one another, each folded paper napkin comprising a single-ply paper web having a longitudinal dimension and a transverse dimension, wherein the paper web has a longitudinal-to-transverse aspect ratio of at least about 2 to 1, and further wherein the napkin contains no longitudinal folds and at least one transverse fold.

It is also an object of the present invention to provide a method for the production of a paper napkin comprising providing a single-ply paper web having a longitudinal dimension and a transverse dimension, wherein the single-ply paper web has a longitudinal-to-transverse aspect ratio of at least about 2 to 1; and folding one transverse free edge of the single-ply paper web toward the other transverse free edge to create two panels in the single-ply paper web.

More particularly, it is an object of the present invention to provide a method for the production of a paper napkin comprising providing a single-ply paper web having a longitudinal dimension and a transverse dimension, wherein the single-ply paper web has a longitudinal-to-transverse aspect ratio of at least about 2 to 1: first folding one transverse free edge of the single-ply paper web toward the other transverse free edge to create a first transverse fold line dividing the longitudinal dimension of the single-ply paper web, and subsequently folding the first transverse fold line toward the transverse free edge to create a second transverse fold line and three panels on the single-ply paper web.

Additionally, it is an object of the present invention to provide a method for the production of a paper napkin comprising providing a single-ply paper web having a longitudinal dimension and a transverse dimension, wherein the single-ply paper web has a longitudinal-to-transverse aspect ratio of at least about 2 to 1; first folding one transverse free edge of the single-ply paper web toward the other transverse free edge to create a first transverse fold line substantially dividing the longitudinal dimension of the single-ply paper web, and subsequently simultaneously folding the doubled adjacent panels adjoining the first transverse fold line toward the transverse free edge to create a second and third transverse fold line and four panels on the single-ply paper web, wherein the two panels adjacent to the first transverse fold line are substantially equal in area.

Additional objects and advantages of the present invention will be apparent from the description, or may be learned by practice of the invention. The objects and advantages of the invention will be realized by the elements and combinations particularly pointed out in the appended claims.

DETAILED DESCRIPTION

Figure 2:
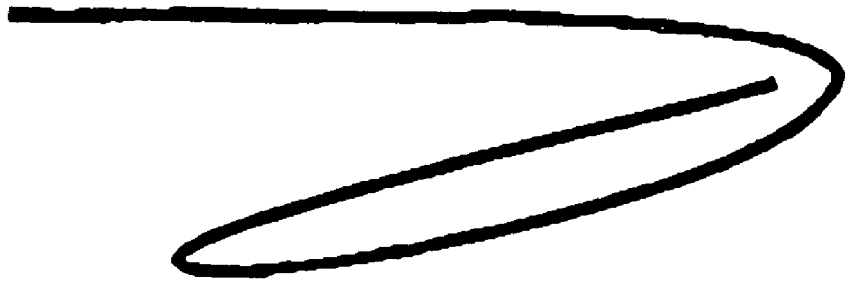
FIG. 2 is a side view illustration of another folded napkin containing two transverse folds in accordance with the present invention.

The paper web used to produce the paper napkins according to the present invention may be manufactured on any conventional papermaking machine. In conventional papermaking, a fibrous slurry of paper making fibers is deposited onto a forming structure to form a nascent web. This forming structure can be a twin wire former, a crescent former or any art recognized forming configuration. The papermaking fibers used to form the web include cellulosic fibers commonly referred to as wood pulp fibers, liberated in the a chemical or mechanical pulping process from softwood (gymnosperms or coniferous trees) and hardwoods (angiosperms or deciduous trees). The particular tree and pulping process used to liberate the tracheid are not critical to the success of the present invention.

Cellulosic fibers from diverse material origins may be used to form the web of the present invention, including non-woody fibers liberated from sabai grass, rice straw, banana leaves, paper mulberry (i.e. bast fiber), abaca leaves, pineapple leaves, esparto grass leaves, and fibers from the genus *hesperalae* in the family agavaceae. Also recycled fibers and refined fibers which may contain any of the above fiber sources in different percentages can be used in the present invention.

Papermaking fibers can be liberated from their source material by any one of the number of chemical pulping processes familiar to the skilled artisan including sulfate, sulfite, polysulfite, soda pulping, etc. Furthermore, papermaking fibers can be liberated from source material by any one of a number of mechanical/chemical pulping processes familiar to anyone experienced in the art including mechanical pulping, thermo-mechanical pulping, and chemi-thermo-mechanical pulping. The pulp can be bleached if desired by chemical means including the use of chlorine, chlorine dioxide, oxygen, etc. These pulps can also be bleached by a number of familiar bleaching schemes including alkaline peroxide and ozone bleaching.

The slurry of the fibers may contain additional treating agents to alter the physical properties of the paper napkin produced. These additives and agents are well understood by the skilled artisan and may be used in any known combination. Because strength and softness are particularly important properties for paper napkins, the pulp can be mixed with strength adjusting agents such as wet strength agents, dry strength agents and debonders/softeners.

Suitable wet strength agents will be readily apparent to the skilled artisan. A comprehensive but non exhaustive list of useful wet strength aids include aliphatic and aromatic aldehydes, urea-formaldehyde resins, melamine formaldehyde resins, glyoxylated polyacrylamide resins, polyamide-epichlorhydrin resins and the like. Of particular utility is the polyamide-epichlorhydrin resins, an example of which is sold under the tradenames Kymene 557LX and Kymene 557H by Hercules Incorporated of Wilmington, Del. These resins and the process for making the resins are described in U.S. Pat. No. 3,700,623 and U.S. Pat. No. 3,772,076 each of which is incorporated herein by reference in their entirety. The pulp preferably contains up to about 30 lbs/ton, more preferably from about 20 to about 30 lbs/ton of a wet strength aid.

Suitable dry strength agents will be readily apparent to one skilled in the art. A comprehensive but non-exhaustive list of useful dry strength aids include starch, guar gum, polyacrylamides, carboxymethyl cellulose and the like. Of particular utility is carboxymethyl cellulose, an example of which is sold under the tradename Hercules CMC by Hercules Incorporated of Wilmington, Del. The pulp preferably contains from about 0 to about 15 lb/ton, more preferably from about 2 to about 5 lbs/ton of dry strength agent.

Alternatively, instead of being incorporated into the pulp, these treating agents can be applied to the web. This may be accomplished through one or more applicator systems and can be to either one or both surfaces of the web. Application of multiple treating agents using multiple application systems helps to prevent chemical interaction of treating materials prior to their application to the cellulose web. Alternative configurations and application positions will be apparent to the skilled artisan.

Suitable debonders and softeners will also be readily apparent to the skilled artisan. These debonders and softeners may be incorporated into the pulp or sprayed upon the web after its formation. Softening and debonding agents are preferably added in an amount of not greater than about 2.0% by weight, more preferably not greater than about 1.0% and most preferably between about 0.1% and about 0.4%.

One preferred softener material is amido amine salt derived from partially acid neutralized amines. Such materials are disclosed in U.S. Pat. No. 4,720,383. Also relevant are the following articles: Evans, Chemistry and Industry, 5 Jul. 1969, Pp. 893-903; Egan, *J. Am. Oil Chemist's Soc.*, Vol. 55(1978), Pp. 118-121; and Trivedi et al, *J. Am. Oil Chemist's Soc., June* 1981, Pp. 754-756. All of the above are herein incorporated by reference in their entirety.

Softeners are often available commercially only as complex mixtures rather than as single compounds. While this discussion will focus predominantly species, it should be understood that commercially available mixtures can generally be used.

Quasoft® 202 is a suitable softener material which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, resulting in a mixture consisting of cationic ethylated and cationic non-ethylated species. A minor proportion (e.g., about 10%) of the resulting amido amines cyclize to imidazoline compounds. Since only the imidazoline portions of these material are quaternary ammonium compounds, the compositions as a whole are pH-sensitive.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

The present invention can also be used with a class of cationic softeners comprising imidazolines which have a melting point of about 0-40° C. when formulated with aliphatic polyols, aliphatic diols, alkoxylated aliphatic diols, alkoxylated polyols, or a mixture of these compounds. These low melting softeners are particularly suitable for the manufacture of the paper napkins according to the present invention. The softener comprising an imidazoline moiety formulated in aliphatic polyols, aliphatic diols, alkoxylated aliphatic diols, alkoxylated aliphatic polyols, or a mixture of these compounds is dispersible in water at a temperature of about 1° C. to about 40° C. The imidazoline moiety has the following chemical structure:

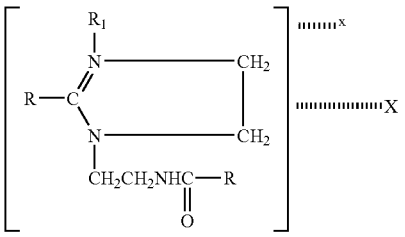

wherein X is an anion and R is selected from the group of saturated and unsaturated paraffinic moieties having a carbon chain length of $C_{12}$ to $C_{20}$. The preferred carbon chain length is $C_{16}$-$C_{20}$. R1 is selected from the group of paraffinic moieties having a carbon chain length of $C_1$-$C_3$. Suitably the anion is methyl sulfate, ethyl sulfate, or the chloride moiety. The organic compound component of the softener, other than the imidazoline, is selected from aliphatic diols, alkoxylated aliphatic diols, aliphatic polyols, alkoxylated aliphatic polyols or a mixture of these compounds having a weight average molecular weight of about 60-1500. The cold water dispersed aliphatic diols have a preferred molecular weight of about 90-150, and the most preferred molecular weight of about 106-150. The preferred diol is 2,2,4 trimethyl 1,3 pentane diol (TMPD) and the preferred alkoxylated diol is ethoxylated 2,2,4 trimethyl 1,3 pentane diol. (TMPD/EO). Suitably the alkoxylated diol is TMPD (EO)n wherein n is an integer from 1 to 7 inclusive. The preferred dispersants for the imidazoline moiety are alkoxytated aliphatic diols and alkoxylated polyols. Since it is hard to obtain pure alkoxylated diols and alkoxylated polyols, mixtures of diols, polyols, and alkoxylated diols, and alkoxylated polyols, and mixtures of only diols and polyols can be suitably utilized. A suitable imidazoline softener is sold by Quaker under the tradename Quasoft 230.

Biodegradable softeners can also be utilized. Representative biodegradable cationic softeners/debonders are disclosed in U.S. Pat. Nos. 5,312,522; 5,415,737; 5,262,007; 5,264,082; and 5,223,096, herein incorporated by reference in their entirety. These compounds are biodegradable diesters of quaternary ammonia compounds, quaternized amine-esters, biodegradable vegetable oil based esters functional with quaternary ammonium chloride and diester dierucyldimethyl ammonium chloride and are representative biodegradable softeners.

After deposition of the fibrous slurry onto the forming wire, the thus-formed wet fibrous web is transferred onto a forming and/or impression fabric which can create a pattern in the web, if desired. After transfer, the web, at some point, is passed through a dryer section which causes substantial drying of the web. The web can be dried using conventional wet-pressing techniques, or, less typically, may be produced using through air drying (TAD). If produced using TAD, once the web is sufficiently dried, the web can be removed directly from the impression fabric. Alternatively, the web can then be transferred to another carrier fabric or may be pressed to the surface of a rotating Yankee drier cylinder to remove additional moisture within the web. Other suitable processes include wet creping or through air drying with wet creping.

The web may be embossed to obtain maximum softness of the single-ply napkin. The web can be embossed with any art recognized embossing pattern, including, but not limited to, overall emboss patterns, spot emboss patterns, micro emboss patterns, which are patterns made of regularly shaped (usually elongate) elements whose long dimension is 0.050 inches or less, or combinations of overall, spot, and micro emboss patterns.

For example, the emboss pattern on the web may produce a napkin that has only an edge emboss. One emboss pattern applied to the area of an edge and extending fully to the edge in substantially complete coverage of the area adjacent the edge has been termed a "coin edge embosses." The advantage of this emboss pattern is that it can improve bulk while it leaves a large, smooth surface for wiping the face and hands.

Another possible embossing pattern covers the entire napkin surface area. The advantage of an overall emboss is that uniform stack bulk is achieved, which promotes good packaging and shelf performance. The desired emboss pattern is generally uniformly distributed on the entire napkin surface area using the overall emboss approach.

Spot embossing, an additional approach, embosses only discrete areas of the napkin surface. Spot embossing is often used along with the traditional embossed edge. This approach generally involves the placement of various sized emboss elements to increase the attractiveness of the folded napkin. Any emboss element, including signature embosses desired by the purchaser, can be used in this approach. Signature embosses refer to any large emboss element that might be selected by the manufacturer. Signature embossments are often associated with brand or manufacturer.

The basis weight of the single-ply web according to the present invention is at least about 16 lbs/3,000 sq. ft. ream, preferably from about 16 to about 32 lbs/3,000 sq. ft. ream. A basis weight range from about 18 to about 26 lbs/3,000 sq. ft. ream is most preferred. It is also possible for the beverage napkins and other non-dispenser napkins according to the present invention to have a basis weight as low as about 13 lbs/3,000 sq. ft. ream.

The tensile strength of the web is measured in both the machine direction and cross-machine direction of the web. The total tensile strength of the web according to the present invention is normally at least about 2000 grams per three inches. Total tensile strength refers to the sum of the machine direction tensile strength and the cross-direction tensile strength. The ratio of the machine direction tensile strength to the cross-machine direction tensile strength is between about 1 and 4. In one preferred embodiment according to the present invention, the ratio is preferably between 1.2 and 1.8.

In still another preferred embodiment, the ratio approaches 1:1. In this embodiment, because the machine direction and the cross-machine direction tensile strength are almost the same, the web is close to "square." This is a highly desirable property because any napkin formed from a "square" web will not possess a noticeable depreciation in tensile strength in any direction.

The napkin according to the present invention is produced using only a single-ply web. The single-ply web is a rectangular sheet having a longitudinal dimension and a transverse dimension. According to the present invention, the longitudinal dimension of the web, or length (longest free edge), is always greater than the transverse dimension, or width (shorter free edge). The longitudinal and transverse dimension of the web are measured from one free edge of the web to the other parallel free edge. The aspect ratio of the web is defined by the ratio of the longitudinal dimension to the transverse dimension. According to the present invention, this longitudinal-to-transverse aspect ratio is at least about 1.7 to 1. This aspect ratio preferably ranges from 1.7:1 to 4:1. Most preferably, the longitudinal-to-transverse aspect ratio ranges from 2:1 to 3:1.

The napkins according to the present invention are free of longitudinal folds and contain at least one transverse fold. Depending on the orientation of the single-ply paper web upon cutting of the individual napkin substrates, the transverse fold can run parallel to either the machine direction or the cross-machine direction of the web.

In one embodiment of the present invention, when the paper napkin contains a single transverse fold, two panels in the rectangular web are produced, a panel being the smallest area surrounded entirely by fold lines and free edges. Being the smallest areas surrounded entirely by fold lines and free edges requires that a panel cannot have a fold line through it. According to the present invention, a panel is defined by the combination of one or more transverse fold lines and the remaining free edges. A transverse free edge is an edge of the rectangular paper defining the width of the web and a longitudinal free edge is an edge defining the length of the web. As described earlier, a transverse fold is a fold running parallel to the width of the napkin and the width of the napkin is always shorter than the length.

Figure 4:
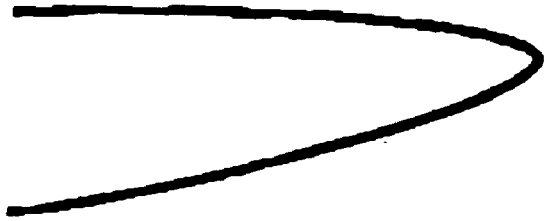
FIG. 4 is a side view illustration of another folded napkin containing one transverse fold in accordance with the present invention. In this napkin, the transverse fold line divides the length of the web approximately in half and forms two panels adjacent to the fold line of approximate equal area.

In one preferred embodiment, the two formed panels are defined by the transverse fold line and the three remaining free edges. The transverse fold line is preferably located in the approximate middle of the length of the rectangular web. The transverse fold line therefore divides the length of the web approximately in half and forms two panels of about equal area. FIG. 4 illustrates this embodiment. The length of the single-ply web in this embodiment preferably ranging from about 9½ inches to about 13½ inches. Most preferably, the length is either about 10 inches or about 13 inches. The width of the web ranges from about 3 to about 7 inches. More preferably, the width is either about 5 inches or about 6½ inches.

In another embodiment of the present invention, the paper napkin contains two transverse folds. The first transverse fold line divides the length of the rectangular web, and the second transverse fold line is located between the first transverse fold line and a free transverse edge of the paper web.

In still another preferred embodiment containing two transverse folds, three panels are formed on the rectangular web. A first panel is defined by the first transverse fold line and the three remaining free edges, the second panel is defined by the first transverse fold line, the second transverse fold line and the two longitudinal free edges, and the third panel is defined by the second transverse fold line and the three remaining free edges. FIG. 2 illustrates this embodiment. In a more preferred embodiment, the first panel is larger than the second and third panels.

Figure 1:
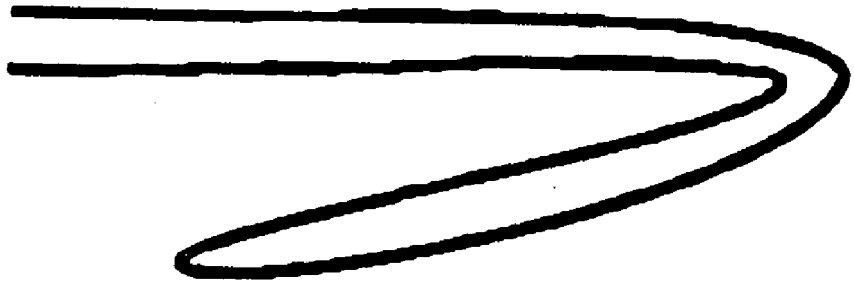
FIG. 1 is a side view illustration of a folded napkin containing three transverse folds in accordance with the present invention. Two of the transverse fold lines in the single-ply paper web are adjacent to one another.
Figure 3:
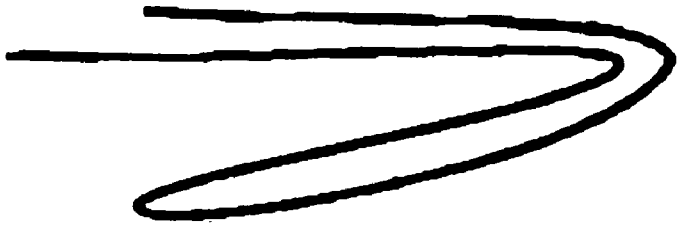
FIG. 3 is a side view illustration of another folded napkin having three transverse folds in accordance with the present invention. This napkin comprises a grasping flap on each side of the napkin.

In another preferred embodiment containing three transverse folds, four panels are formed on the rectangular web. A first panel is defined by the first transverse fold line and the three remaining free edges, the second panel is defined by the first transverse fold line, the second transverse fold line and the two longitudinal free edges, the third panel is defined by the second transverse fold line, the third transverse fold line and the two longitudinal free edges, and the forth panel is defined by the third transverse fold line and the three remaining free edges. In this embodiment, the area of the second and third panel are equal. When the paper napkin containing three folds is in its folded state, the first and third fold lines in the web are adjacent to one another. FIGS. 1 and 3 are illustrative of this embodiment. In a more preferred embodiment, the first and fourth panels have substantially equal area. In still a more preferred embodiment, the first and fourth panels have an area larger than that of the second and third panels.

Figure 5:
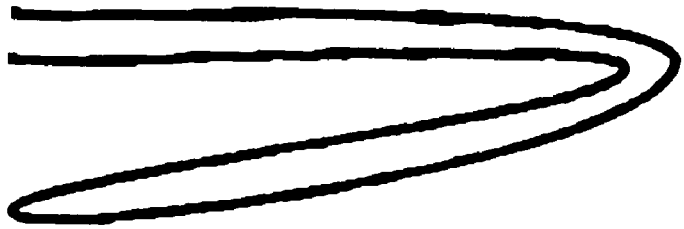
FIG. 5 is a side view illustration of another folded napkin containing three transverse folds in accordance with the present invention. In this napkin, the three transverse fold lines form four panels of approximate equal area.
Figure 9:
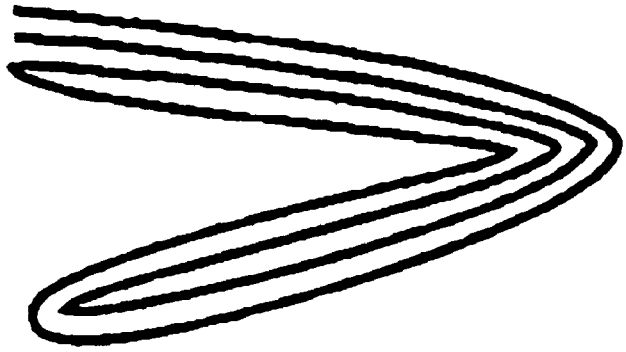
FIG. 9 is a side view illustration of a napkin formed using three transverse folding operations to create seven transverse folds.

In still another embodiment of the present invention, the paper napkin contains three transverse folds. The first transverse fold divides the length of the rectangular web, the second transverse fold is formed in the now folded web between the first transverse fold and a free transverse edge of the paper web, and the third transverse fold is then again formed between the first transverse fold and the free transverse edge of the paper web. Such a napkin is illustrated in FIG. 5. In another embodiment, the napkin of FIG. 5 is subjected to yet another folding operation to form an "airline" or "ribbon" napkin which when fully opened, comprises eight panels and seven transverse folds formed on the single-ply paper web by the three folding operations. Such a napkin is illustrated in FIG. 9.

When the paper napkins according to the present invention contain two or more transverse folds, the length of the single-ply web in this embodiment preferably ranging from about 11½ inches to about 17½ inches. Most preferably, the length is about 12 inches, about 13 inches or about 17 inches. The width of the web ranging from about 4½ inches to about 9 inches. Most preferably, the width is about 5 inches, about 6½ inches, about 7½ inches, or about 8½ inches.

When the paper napkins according to the present invention contain two or more transverse folds, it is also preferred that the napkins have an off-fold configuration. When a napkin has an off-fold configuration, the larger, in terms of area, of the two exterior panels defined by a transverse line and three free edges has an area greater than the adjacent panel defined by the same transverse fold line, another transverse fold line and two free longitudinal edges. The folded paper napkin with an off-fold configuration according to the present invention will also have a nonuniform thickness across the surface of the napkin. Therefore, the folded paper napkin possesses a flap, formed from two adjacent panels of the web, that allows for easy extraction of the napkin from the napkin dispenser.

For dispenser napkins of the type where the consumer grasps only a single panel comprising a single ply to remove the napkin from the dispenser, it is preferred that the tensile strength of the napkin in the direction parallel to the direction of dispensing exceeds about 3000 g/3 in. Preferably, in such a napkin the tensile strength in the direction parallel to the direction of dispensing will exceed about 3500 g/3 in., more preferably being in excess of about 4000 g/3 in., most preferably in excess of about 4500 g/3 in. If the napkin is of a style where the consumer grasps two panels to remove it, the corresponding preferred strengths may be halved.

The paper napkins according to the present invention can be folded using conventional automated folders. In a preferred embodiment of the present invention, an automated machine that contains turning bars or rolls in place of forming plates is employed. Because the napkins according to the present invention do not contain longitudinal folds, forming plates are not required. The elimination of the forming plates increases the production efficiency of the napkins.

Figure 6:
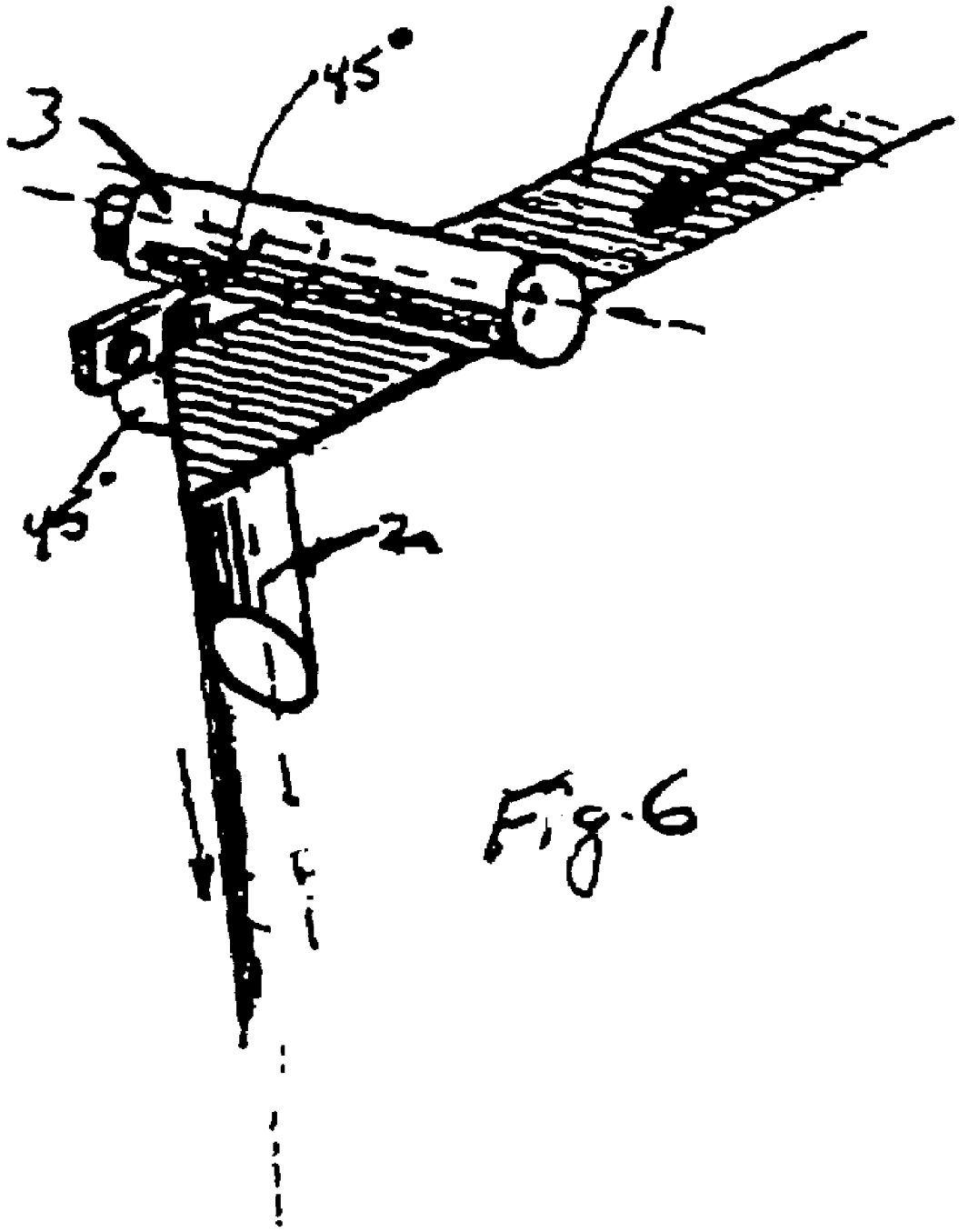
FIG. 6 is a perspective view illustrating rollers used in accordance with the invention to re-direct the web.

Specifically, the paper napkins according to the present invention can be folded using conventional automated folders modified to eliminate any longitudinal folding and to produce the transverse folded napkin of the present invention. For example, U.S. Pat. No. 4,475,730 to Trogan, incorporated herein by reference, describes an apparatus for continuously folding a plurality of webs of paper or the like, preferably into a "C" fold configuration. U.S. Pat. No. 5,088,975 to Ghilardi (also incorporated herein by reference) describes an apparatus for the production of paper napkins which includes a feeder for continuously supplying a web of material, a slitter for cutting the web into longitudinal strips, a first folder to fold the strips lengthwise, a transverse cutter, a transverse folder and a stacker. In accordance with the present invention, the device of Ghilardi would be modified, for example by eliminating the longitudinal folding. In a preferred embodiment of the present invention, an automated machine that contains turning bars or rollers in place of forming plates is employed to orient the web properly for transverse folding in accordance with the invention. Generally, the turning bars or rollers are positioned just prior to the fly knife and anvil rolls and reorient the continuous, moving web of material being drawn from the former into a plane that is perpendicular to the original plane of the moving web and at a 90° angle as shown in FIG. 6 of the drawings. In order to achieve this reorientation of web 1, the longitudinal axis of roller or bar 2 is obliquely angled at about a 45° angle both vertically and laterally from the longitudinal axis of roller 3, which is oriented parallel to the plane of the web and transverse to the direction the web is traveling.

In a preferred embodiment for folding the napkins according to the present invention, one transverse free edge of the web is folded towards the other transverse free edge to create two panels in the web. Each panel is defined by the transverse fold line the two longitudinal free edges and the respective transverse free edge. It is most preferred that the area of the two formed panels are equal in this method.

One method of forming napkins, such as those shown in FIGS. 1, 3, and 5—termed "book folded" napkins, uses what is called "book folding". When the book folded paper napkins according to the present invention contain at least two transverse folds, one transverse free edge of the web is folded towards the other transverse free edge to create two panels in the web. The transverse fold in the napkin is then folded, in the same direction as the first fold, toward the transverse free edge of the web. If more folds are desired, the most recently formed transverse fold in the napkin is folded, in the same direction as the previous folds, toward the transverse free edge of the web.

The first transverse free edge of the web can be folded "up" or "down" toward the other transverse free edge. "Up" and "down" are relative terms that are dependent upon the orientation of the web during formation of the napkin. In one preferred embodiment, the folds are either all "up" or all "down," during production of the dispenser napkins according to the present invention. A folding method in which all the folds are made in the same direction can serve to speed the production time of the napkins.

Figure 8:
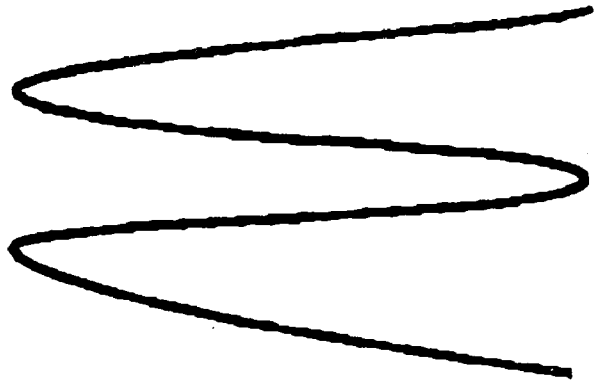
FIGS. 7 and 8 are side view illustrations of napkins formed with tablet folds having 2, and 3 transverse fold, respectively.
Figure 7:
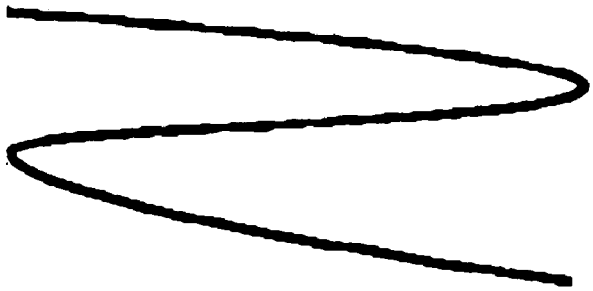

Another method of forming napkins, such as those shown in FIGS. 7 and 8—termed "tablet folded" napkins, uses what is called "tablet folding". In tablet folded napkins of the present invention, all folds are preferably formed substantially by a plow which imposes an accordion like fold on the moving web.

The paper napkins according to the present invention can then be stacked and packaged. The paper napkins are generally oriented in the same direction and stacked one on top of another. When the napkins are oriented in the same direction, the two longitudinal free edges and at least one transverse free edge of a single napkin directly correspond to the same edges in all other napkins contained in the stack. In a preferred embodiment, the off-fold flap faces in the same direction throughout the stack and the corresponding longitudinal free edges of the napkins form two parallel planes.

The stack of paper napkins can then be wrapped by any conventional wrapping means, such as by paper or poly-wrap. Alternative packaging and orientations of the napkins are usually less preferred than those described above but are readily apparent to the skilled artisan.

Most stacks of napkins according to the present invention are intended to be placed in a conventional napkin dispenser. The paper napkin dispensers contemplated by the present invention include a housing containing an opening for individually dispensing paper napkins from a stack of paper napkins, such as a cassette napkin dispenser. It is preferred that the napkin dispenser contain a means inside the housing, such as a spring, to urge the paper napkins toward the opening and an access means, such as a hinged lid, for refilling the dispenser.

The following examples are illustrative of, but are not to be construed as limiting, the invention embodied herein.

EXAMPLES

Napkins were produced having the properties and sizes noted in Table 1, below.

TABLE 1

| | Overall Size | | Folded Size | | | | | | | | |
|---|---|---|---|---|---|---|---|---|---|---|---|
| | | | | | Front | Rear | | | | | |
| Napkin | Width (in) | Length (in) | Width (in) | Height (in) | Panel (in) | Panel (in) | BW (lbs/3000 ft$^2$) | MDDT (gms/3 in) | CDDT (gms/3 in) | Caliper | Ref. FIG. |
| SuperServ | 6 ½ | 17 | 6 ½ | 5 | 3 ½ | 5 | 22 | 4800 | 2700 | 48 | 1 |
| Marquis | 4 ⅞ | 17 | 4 ⅞ | 6 ¾ | 5 ¼ | 6 ¾ | 22 | 4800 | 2700 | 48 | 2 |
| DemiServ | 6 ½ | 13 | 6 ½ | 3 ¾ | 2 ¾ | 3 ¾ | 22 | 4800 | 2700 | 48 | 1 |
| ServRite | 6 ½ | 12 | 6 ½ | 5 | 3 ½ | 5 | 22 | 4800 | 2700 | 48 | 2 |
| Double off-fold | 6 ½ | 15 ½ | 6 ½ | 5 | 3 ½ | 3 ½ | 22 | 4800 | 2700 | 48 | 3 |
| Compact | 3 ½ | 12 | 3 ½ | 5 | 3 ½ | 3 ½ | 22 | 4800 | 2700 | 44 | 2 |
| Luncheon (1/4 F) | 6 ½ | 12 | 6 | 6 ½ | n/a | n/a | 22 | 4800 | 2700 | 40 | 4 |
| Dinner (1/4 F) | 7 ½ | 15 | 7 ½ | 7 ½ | n/a | n/a | 22 | 4800 | 2700 | 40 | 4 |
| Dinner (1/4 F) | 7 ½ | 17 | 7 ½ | 8 ½ | n/a | n/a | 22 | 4800 | 2700 | 40 | 4 |
| Dinner (1/8 F) | 7 ½ | 17 | 3 ¾ | 8 ½ | n/a | n/a | 22 | 4800 | 2700 | 40 | 5 |
| Dinner (1/4 F) | 8 ½ | 17 | 8 ½ | 8 ½ | n/a | n/a | 22 | 4800 | 2700 | 40 | 4 |
| Dinner (1/8 F) | 8 ½ | 17 | 4 ¼ | 8 ½ | n/a | n/a | 22 | 4800 | 2700 | 40 | 5 |

Table 1 provides examples of the various paper napkins according to the present invention. These napkins vary, for example, in the overall size dimensions of the paper web, and the folded size of the napkin. Table 1 further sets forth the physical properties and the height of the front and rear panels of the exemplified folded napkins.

We claim:

1. A method of making a paper napkin comprising:

(a) providing a single-ply paper web having a machine direction and a cross machine direction, wherein a longitudinal dimension is in the machine direction and a transverse dimension is in the cross-machine direction, and wherein the longitudinal dimension is at least about two times the transverse dimension;

(b) optionally orienting the web for longitudinal folding in the machine direction; and (c) folding one transverse free edge of the single-ply paper web toward the other transverse free edge to create two panels in the single-ply paper web;

wherein the napkin contains no longitudinal fold and at least one transverse fold.

2. The method according to claim 1, wherein the two panels have approximately equal areas.

3. The method according to claim 1, wherein the single-ply paper web provided has a longitudinal dimension ranging from about 9½ inches to about 13½ inches, and a basis weight of at least about 13 lbs/3000 sq ft ream.

4. The method according to claim 3, wherein the two panels have approximately equal areas.

5. A method of making a paper napkin comprising:

(a) providing a single-ply paper web having a machine direction and a cross machine direction, wherein a longitudinal dimension is in the machine direction and a transverse dimension is in the cross-machine direction, and wherein the longitudinal dimension is at least about two times the transverse dimension;

(b) optionally orienting the web for longitudinal folding in the machine direction;

(c) first folding one transverse free edge of the single-ply paper web toward the other transverse free edge to create a transverse fold line dividing the longitudinal dimension of the single-ply paper web, and (d) subsequently folding the first transverse fold line toward the transverse free edge to create at least one additional transverse fold line on the single-ply paper web;

wherein the napkin contains no longitudinal fold and at least two transverse folds.

6. The method according to claim 5, wherein three panels are formed on the single-ply paper web.

7. The method according to clam 5, wherein four panels are formed on the single-ply paper web.

8. The method according to claim 5, wherein the single-ply paper web provided has a longitudinal dimension ranging from about 11½ inches to about 17½ inches, and a basis weight of at least about 16 lbs/3000 sq ft ream.

9. The method according to claim 6, wherein the two panels adjacent to the first transverse fold line are approximately equal in area.

10. The method according to claim 6, wherein the two panels adjacent to the transverse free edges of the single-ply web are approximately equal in area.

11. The method according to claim 7, wherein the four panels formed on the single-ply paper web are approximately equal in area.

* * * * *